United States Patent [19]

Fukumoto

[11] Patent Number: 4,671,343

[45] Date of Patent: Jun. 9, 1987

[54] HEAT EXCHANGER HAVING SPIRALLY WOUND TUBES

[75] Inventor: Masafumi Fukumoto, Amagasaki, Japan

[73] Assignee: Nisshin Chemical Industry Co., Ltd., Amagasaki, Japan

[21] Appl. No.: 708,363

[22] Filed: Mar. 4, 1985

Related U.S. Application Data

[62] Division of Ser. No. 403,227, Jul. 29, 1982, Pat. No. 4,538,678.

[51] Int. Cl.[4] ..... F28D 7/02; F28F 21/06

[52] U.S. Cl. ..... 165/162; 165/163; 165/905

[58] Field of Search ..... 165/162, 163, 172, 905

[56] References Cited

U.S. PATENT DOCUMENTS

| | | | |
|---|---|---|---|
| 3,496,997 | 2/1970 | Weber | 165/163 |
| 3,616,848 | 11/1971 | Kaelin | 165/162 X |
| 4,190,104 | 2/1980 | Frei | 165/162 |

FOREIGN PATENT DOCUMENTS

| | | | |
|---|---|---|---|
| 2734060 | 2/1979 | Fed. Rep. of Germany | 165/163 |
| 2017895 | 10/1979 | United Kingdom | 165/905 |
| 2075172 | 11/1981 | United Kingdom | 165/163 |

*Primary Examiner*—Albert W. Davis, Jr.
*Assistant Examiner*—John K. Ford
*Attorney, Agent, or Firm*—Gabriel P. Katona

[57] ABSTRACT

Heat exchanging device wherein plural number of support plates are provided at a required distance from one another, a plurality of through holes are formed on these support plates, a plurality of heating tubes of a fluorocarbon resin are put in each of the through holes independently from one another and these heating tubes are held by the support plates.

4 Claims, 16 Drawing Figures

HEAT EXCHANGER HAVING SPIRALLY WOUND TUBES

This is a divisional of U.S. Ser. No. 403,227 filed July 29, 1982, now U.S. Pat. No. 4,538,678 granted Sept. 3, 1985.

BACKGROUND OF THE INVENTION

The present invention relates to a heat exchanging device, and, more particularly, to a heat exchanging device wherein chemical liquids are used as fluids to be heated or cooled in the automotive industry and chemical industry as well as other metallic surface treatment industry, the plating industry and the like.

In a heat exchanging device of this kind, when the object to be cooled or heated is a chemical liquid such as sulfuric acid and the like, fluorocarbon resin tubes a of superfine diameter as shown in FIG. 1 have conventionally been used. A plurality of these tubes are tied up in a bundle with a bandlike member b in such a manner that the horizontal cross section of the concentric tubes presents a honeycombed shape. A heating medium, for example, steam, is allowed to circulate in each tube a. It is because the heat-exchanging efficiency for chemical liquids might be increased that the concentric tubes are formed to present the horizontal cross-section of honeycombed shape with each tube of fluorocarbon resin a having a superfine diameter. Constructing each tube thin means easy breakableness of the tube as a result of an increase in the pressure in the tube and the like. Once a breakage has occurred on the tube, steam comes to mix in the chemical liquid to turn the chemical liquid into an impurified and contaminated substance. Therefore, when breakage of tubes is found, it is necessary to remove the damaged tubes immediately. It, however, is impossible in fact to pick up only a damaged tube because the tubes are tied up in a bundle in a plurality with a bandlike member and each tube with a small diameter is combined in a bundle inseparably from one another. Also it is difficult to find out a damaged tube. Even when a damaged tube has been found out, it is impossible to cut off the damaged portion to restore it by deposition and the like because of the superfineness of the tube a's diameter. Thus the conventional type of heat exchanging device has such an uneconomical disadvantage that it is necessary not only to exchange the tube a itself but also to scrap the damaged tube.

The primary object of the present invention is, removing difficulties in the conventional heat exchanging devices mentioned above, to provide a highly efficient heat exchanging device having further merits such as: easiness to find out damaged heating tubes, detachableness of damaged heating tubes exclusively from the support body, big advantageousness in the aspects of maintenance, workability and economy, and largeness of the heat-exchange surface area per heating tube.

Other object of the present invention is to provide a heat exchanging device which may endure sufficiently against deformation or vibration of the heating tubes due to the heating fluids applied to the heating tubes.

Further object of the present invention is to provide a heat exchanging device wherein not only effective heat-exchange is performed with an increased coefficient of heat transmission but also improvement in its durability can be expected.

In the accompanying drawings, FIGS. 2 to 16, there are shown illustrative embodiments of the invention from which these and other of its related objectives and features will be readily apparent.

DESCRIPTION OF PREFERRED EMBODIMENTS

Figure 1:
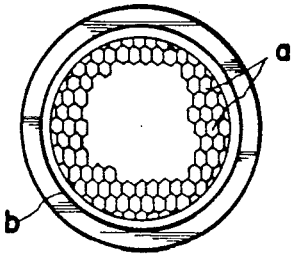
FIG. 1 is a vertical cross section illustrating the principal part of a conventional heat exchanging device.
Figure 2:
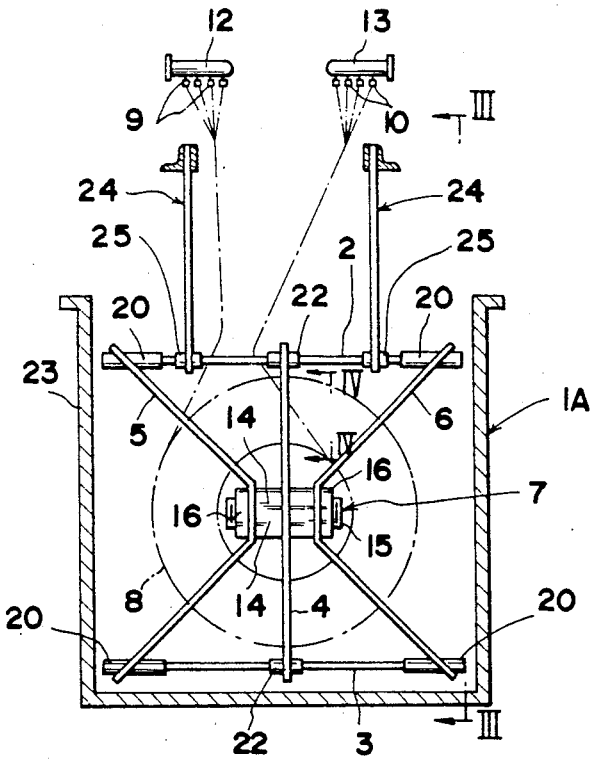
FIG. 2 is a vertical cross section of one embodiment of the heat exchanging device of the invention.
Figure 3:
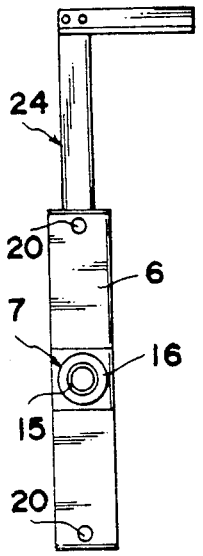
FIG. 3 is a cross section taken on line III—III of FIG. 2.
Figure 4:
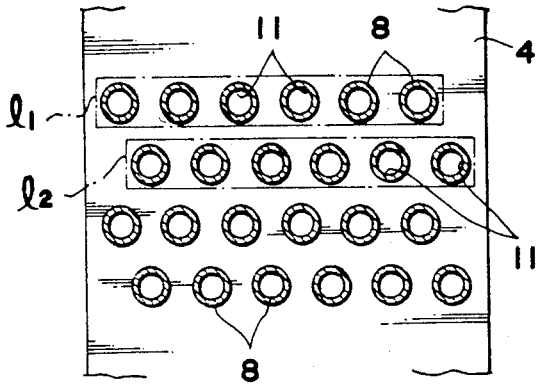
FIG. 4 is a grossly enlarged sectional view taken on line IV—IV of FIG. 2.

In FIGS. 2 and 3, a signal 1A denotes a heat exchanging device which is one of the embodiments of the present invention. Said heat exchanging device 1A has an upper and lower support frames 2 and 3 transversely in parallel with respect to each other. A substantially I-shaped support plate 4 of a fluorocarbon resin, for example, polytetrafluoroethylene, connects both support frames at the middle of each frame. A pair of substantially V-shaped support plates 5, 6 of polytetrafluoroethylene are provided substantially hyperbolically at both sides of said support plates with the I-shaped support plate 4 as the central axis. Each of the end portions of these V-shaped support plates 5, 6 is connected to each of the end portions of the support frames 2, 3. Both central portions of the support plates 5, 6 are integrally connected to the central portion of the I-shaped support plate 4 with a bolt joint 7. On the other hand, each of a plurality of heating tubes 8 used in the heat exchanging device 1A is made of a fluorocarbon resin, for example, polytetrafluoroethylene, and at both ends thereof connecting plugs 9, 10 are provided. Thus constructed heating tubes 8 are held by the V-shaped support plates 5, 6 and the I-shaped support plate 4 through each of the through holes 11 which are formed on each of these plates 4, 5, 6 in large numbers so that the heating tubes may perpendicularly form spirals in such a manner that the spirally-formed heating tubes 8 form ranks. That is, each of the heating tubes 8 is constructed so as to wind continually about and constantly receding from the center along the perpendicular surface. The outer end of each heating tube 8 is connected to the connector on the input side 12 through connecting plugs 9, and the inner end of each heating tube to the connector on the output side 13 through connecting plugs 10. As mentioned above, the heating tubes 8 are provided in parallel to one another, avoiding mutual contacts and keeping ranks, to form spirals. In this case, the through holes 11, which are perforated on the support plates 4, 5, 6, are provided in such a manner that the through holes 11 belonging to a line $l_1$ are formed at staggered positions with respect to those of the through holes 11 belonging to an adjacent line $L_2$, as shown in FIG. 4. This is because the surface area in which the heat exchange will occur is certainly maintained. The bolt joint 7 which connects the V-shaped support plate 5, 6 and the I-shaped support plate 4 is well-known one, and has such a construction that collars of polytetrafluoroethylene 14 are provided at both sides of the support plate 4, and the support plate 4, the collars 14 and the support plates 5, 6 are connected by a bolt 15 through a hole and at both ends thereof nuts 16 are provided.

Figure 5:
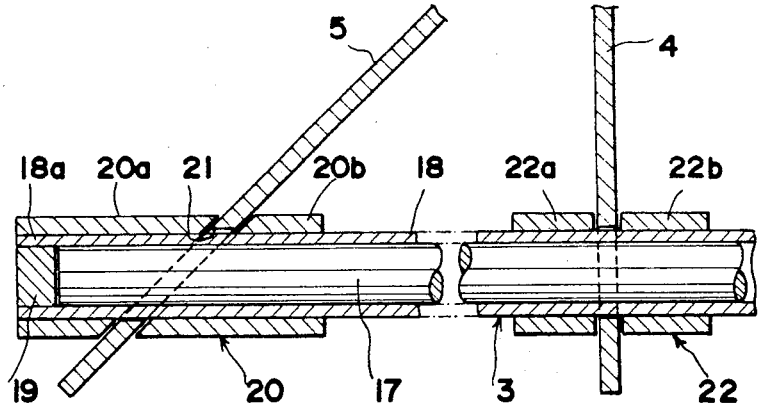
FIG. 5 is a greatly enlarged detailed vertical sectional view of the principal part of the support frames in the device illustrated in FIG. 2.

As shown in FIG. 5, said support frames 2, 3 are constructed in such a manner that a steel core 17 is covered with a relatively thin outer tube 18 of polytetrafluoroethylene which is somewhat longer than said core, said tube 18 is heated and shrunk to give intimate contact to the core 17 and, with each of end portions 18a of said tube fitted by plugs of polytetrafluoroethylene 19 in order to plug said tube 18, is welded integrally by applying heat. In FIG. 5, said core 17 is illustrated in the form of solid bar, but it may also be hollow, namely, tubular. Still more, numeral 20 in FIG. 5 designates a member for locking V-shaped support plates. Said lock member is made of a thick wall tube of polytetrafluoroethylene, and cutting this tube slantwise with a given inclination, divided members 20*a*, 20*b* are formed. These divided members 20*a*, 20*b* are made to fit on each end of the support frames 2, 3. Each end of the V-shaped support plates 5, 6 is inserted respectively in the support frames 2, 3 through thrust holes 21 in such a manner that each of them is held between the sloped cut surfaces of the divided members 20*a*, 20*b*. These divided members 20*a*, 20*b* are heated and shrunk to stick to the support frames 2, 3 with pressure, and thereby the ends of the support plates 5, 6 are fixed. Numeral 22 denotes members for locking the T-shaped support plates. Said lock members 22 comprise divided members 22*a*, 22*b* of a same shape formed by thick-wall tube of polytetrafluoroethylene, whose function being the same as that of said lock members 20. In FIG. 2, numeral 23 designates a box-shaped bath wherein desired chemical liquids are put, and an assembly of the support plates 4, 5, 6, the support frames 2, 3 and the spirally-formed heating tubes 8 is made to sink in said bath 23 by means of suspending members 24. From the connector on the input side 12, steam, for example, is supplied. Steam goes on spirally through and along each heating tube 8, and then it is discharged outside from the connector on the output side 13. Therefore, heat-exchange between steam and a chemical liquid is accelerated through the diaphragms of the heating tubes in the bath 23, thereby the temperature of the chemical liquid rises. The lowermost portion of said suspending members 24 are fixed to the upper support frame 2 by lock members 25 which are the same ones as the members for locking I-shaped support plates 22.

The heat exchanging device 1A, with such a construction as mentioned above, has such merits that the compactification of the whole heat exchanging device 1A, easy handling, and holding down the occupied space have all come to be possible even though the actual length of each heating tube 8 is long in order to increase the surface area where the heat-exchange occurs, because a plurality of heating tubes 8 are spirally held by the support plates 4, 5, 6 in a form of ranks. Moreover, for the same reason as mentioned above, provision of heating tubes of a superfine diameter is not required as has been conventionally, so that the heating tubes 8 can sufficiently endure changes of the inner pressures and they will not be damaged easily. Also damaged heating tubes 8 are to be found easily and it is possible to remove the damaged tubes alone from the support plates 4, 5, 6, because the heating tubes 8 are of relatively small diameter and yet each of the heating tubes 8 is provided independently from one another in ranks. That is, damaged tubes can be removed easily, because it is not necessary to disjoint the whole device even when damages to heating tubes occur. Still more, each of the support frames 2, 3 is formed by coating the steel core 17 with the outer tubes of a fluorocarbon resin 18 and causing the support frames to be fitted by the outer tubes by thermal shrinking, and further, by fixing plugs 19 of a fluorocarbon resin into each end portion 18a of the tube 18 and welding them by applying heat so that the outer tube 18 may be sealed. Such a construction of the device produces a larger increase by far in the mechanical strengths of the support frames 2, 3 in comparison to that of the conventional support frames of a fluorocarbon resin alone to the extent that deformations are hardly caused in the support frames 2, 3 by increases in the temperature of the chemical liquid in the bath 23 or vibrations as a result of hammer shocks generated on the heating tubes 8. These lead to the fact that sure maintenance of the heating tubes 8 is guaranteed and that cheapening of the production costs can be expected because in these support frames 2, 3, a fluorocarbon resin is used only on the outer layer of the frames and the core thereof is made of steel which is relatively cheap.

Figure 6:
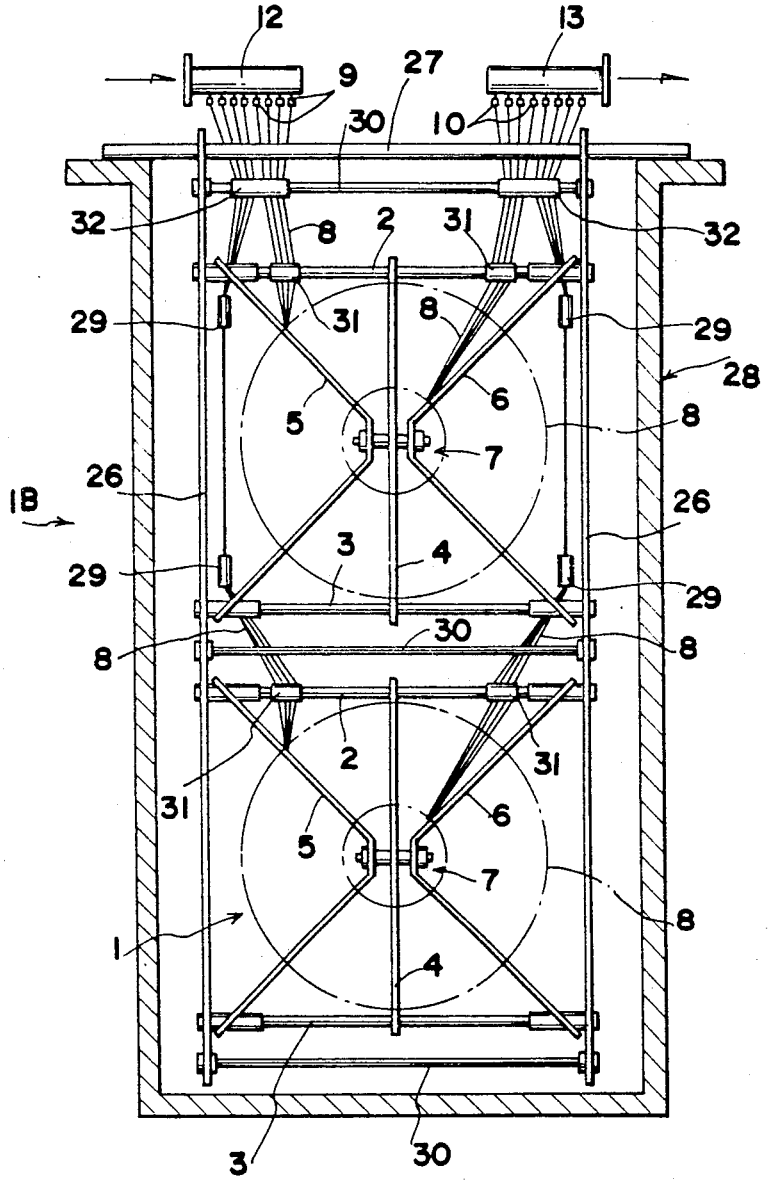
FIG. 6 is a vertical cross section of another embodiment of the heat exchanging device of the invention.
Figure 7:
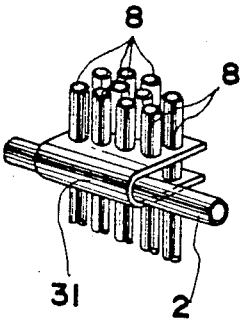
FIG. 7 is a perspective view of one of the fixtures of the heating tubes in the device illustrated in FIG. 6.

FIG. 6 shows a heat exchanging device 1B wherein a multistage (two stages) of the heat exchanging devices 1A are put. In said device, as seen in the figure, each support frame 2, 3, whose upper and lower frame form a pair, is connected integrally by connecting plates 26 and thus formed assembly is sunk in a bath 28 by providing a suspended frame 27 spanning between both upper end portions of the connecting plates 26 at the upper end of the bath 28. While numeral 29 denotes converging members leading heating pipes 8 of the lower stage upward in a converged state, numeral 30 denotes support pipes holding the upper and lower end portions and the middle portion of the connecting plates 26. Numeral 31 denotes fixtures to fix the end portions of the heating tubes 8 on the input side and output side to the support frames 2. One of said fixtures is also shown in FIG. 7. Numeral 32 denotes fixtures, the same ones as said fixtures 31, to fix the end portions of the heating tubes 8 on the input side and the output side to the support pipes 30.

Figure 8:
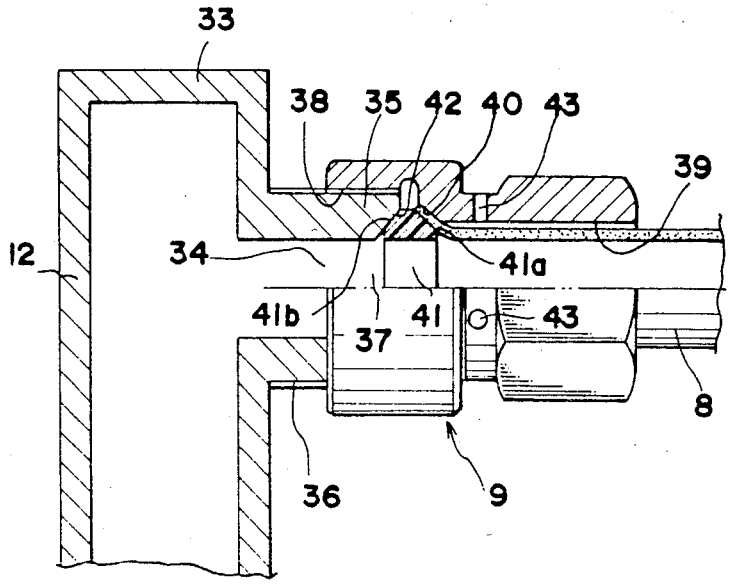
FIG. 8 is a cross section of the connection structure of connectors and plugs in the device illustrated in FIG. 6.

In respect of the connection structure of a connector 12 and connecting plugs 9 on the input side and a connector 13 and connecting plugs 10 on the output side, explanations will be given by reference to FIG. 8. The connector 12 takes a bottomed cylindrical shape with an end face thereof closed with a lid 33, and branched outlets 34 of the same number as that of the plugs connected thereto are provided at its side. Each branched outlet 34 has s short sleeve 35 construction, and on the outer circumferential surface of the short sleeve 35, a screw portion 36 is provided. A bore 37 in which the branched outlet is inserted is formed on one end of the plug 9, and a nut portion 38 which corresponds to said screw portion 36 is provided on the inner circumferential surface of said bore 37. On the other end of the plug 9, a bore 39, in which a heating tube is inserted, of a smaller diameter than that of the bore 37 in which a branched outlet is inserted is formed and a tapered face 40 is formed at the portion where the bore 37 communicates with another bore 39 with its diameter increasing gradually from the bore 39 to the bore 37. Numeral 41 denotes a ring-shaped packing of polytetrafluoroethylene and said packing with a triangular section is provided in such a manner that the thickness of the wall on the outer circumference is smaller than that of the wall on the inner circumference. In connection, the heating tube 8 is inserted from the bore 39 side to allow the top of the heating tube 8 to be positioned along the tapered face 40. At this state, the ring-shaped packing 41 is fittingly provided from the bore 37 in which the branched outlet is inserted so that the top portion of the heating tube 8 may be held between a slope 41*a* of the ring-shaped packing 41 and the tapered face 40. Then, the plug 9 is fixed by a screwing operation between the screw portion 36 and nut portion 38 through the branched outlet 34. The internal angle portion of the short sleeve 35 constructing the branched outlet 34 forms a cut tapered face 42, which is made to contact to another slope 41*b* of the ring-shaped packing 41 by the screwing operation mentioned above. As a result, compressive forces come to act on the ring-shaped packing 41 from both directions of slopes 41*a*, 41*b* to allow the top portion of the heating tube 8 to be sealed at a portion between the tapered face 40 on the plug 9 side and the ring-shaped packing 41. The branched outlet 34 is also sealed between the tapered face 42 on the short sleeve side and the ring-shaped packing 41. Therefore, a steam leak at this connecting portion is prevented satisfactorily, even when steam flows from the connector 12 side to the heating tube 8. Though there is a danger of thermal expansion's being generated on the tube 8, the short sleeve 35 and the plug 9 due to the circulating steam and a difference of the quantity of the thermal expansion may cause a change in the compressive force acting on the ring-shaped packing 41, the ring-shaped packing 41 may undergo deformation responding to the change of said compressive force to present effective sealing effects on the place in question even when compressive force acts on both slopes 41*a*, 41*b* from both sides, because the ring-shaped packing 41 has such a construction that it not only has a triangular section but also the thickness of the wall on the outer circumference is smaller than that of the wall on the inner circumference so that the inner circumferential surface side may remain at a state wherein sufficient elasticity is given. Numeral 43 denotes a vent hole. When it is a chemical liquid that is supplied from the connector 12 side to the heating tube 8, gas transmission of the chemical liquid occurs through molecules of the heating tube 8 and the resulting transmitted gas leaks out through the connecting tube 8. If the transmitted gas collects in a space between the connecting tube 8 and the plug 9, the plug 9 may suffer from damages. The vent hole 43 carries out the function to release the gas, which tends to collect in the space between the plug 9 and the connecting tube 8 after the gas transmission mentioned above, surely out of the plug 9. The explanations have been given with respect to the input side. It is, however, noted that the same also applies to the output side, accordingly the explanations with respect to the construction of the output side are omitted.

Figure 9:
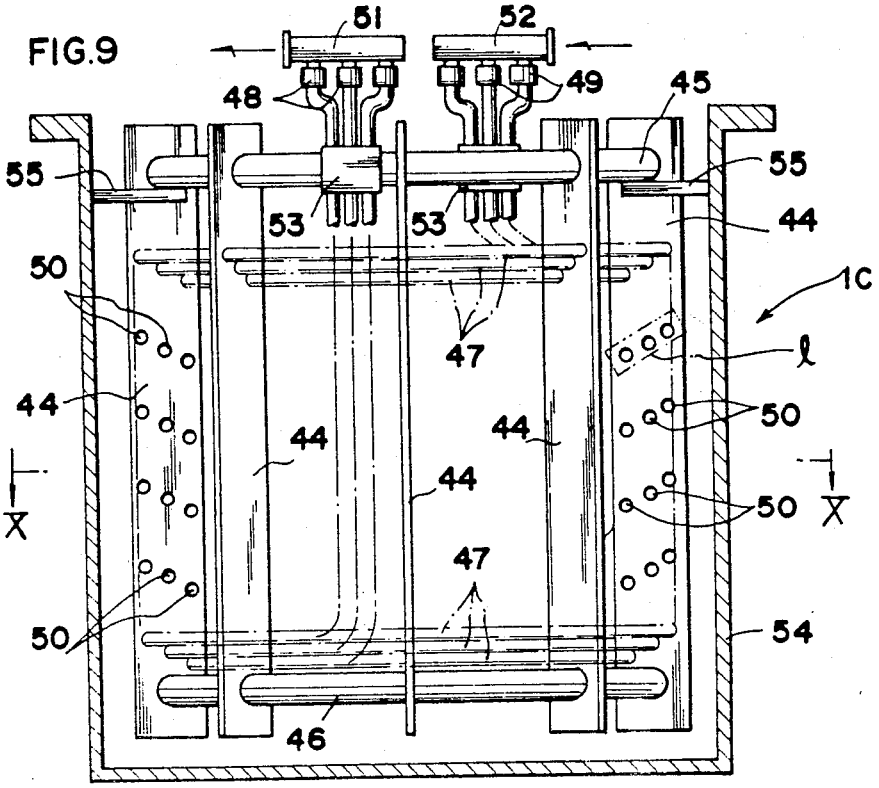
FIG. 9 is a vertical cross section of other embodiment of the heat exchanging device of the invention.
Figure 10:
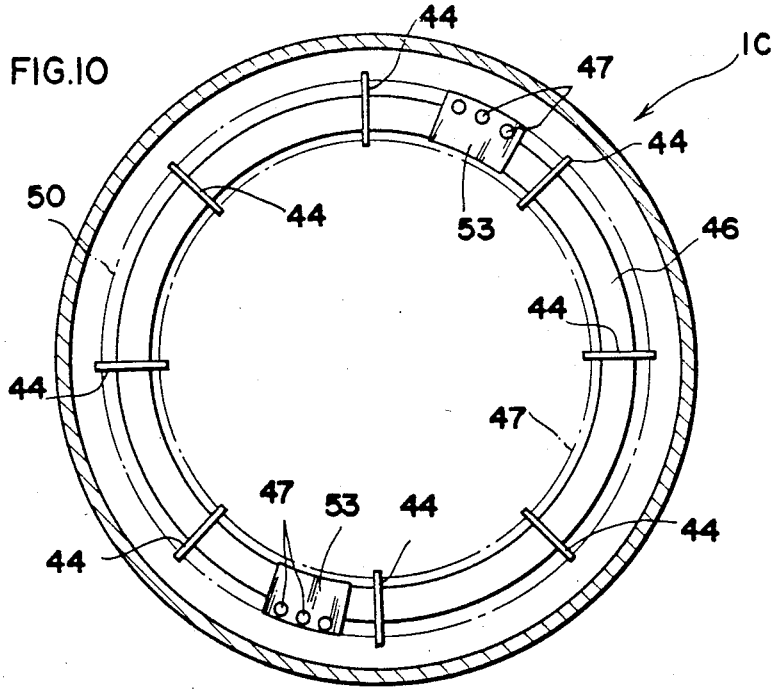
FIG. 10 is a cross section taken on line X—X of FIG. 9.

FIGS. 9, 10 show a heat exchanging device 1C which is other embodiment of the present invention. In said device 1C, plural number of support plates 44 of polytetrafluoroethylene are vertically provided respectively at a required distance in the circumferential direction. Annular support frames 45, 46 of polytetrafluoroethylene connect these support plates 44 integrally at their upper end portions and lower end portions respectively. Each of the heating tubes 47 used in this heat exchanging device 1C is made of polytetrafluoroethylene, and connecting plugs 48, 49 are provided at both ends thereof. The heating tubes 47 of such a construction are provided spirally in ranks gradually from top to bottom through the through holes 50 perforated on each support plate 44. Each upper end of the heating tubes 47 is connected to a connector 52 on the input side through connecting plugs 49, and each lower end of the heating tubes 47 to a connector 51 on the output side through connecting plugs 48. As mentioned above, the heating tubes 47 are spirally provided in plural number in ranks, and in this case, through holes 50 perforated on the support plates 44 should be provided to form each rank at vertically staggered positions as shown in a rank $l_1$ in FIG. 9. This is because the surface area where the heat-exchange between the heating tubes 47 and the chemical liquid is carried ou might be secured.

Figure 11:
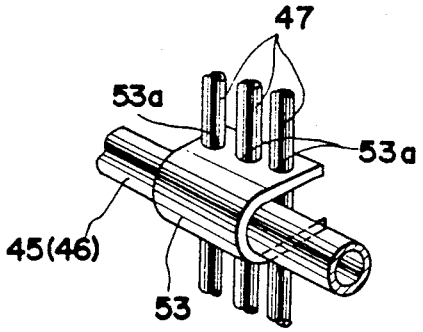
FIG. 11 is a perspective view of one of the fixtures of the heating tube in the device illustrated in FIG. 9.

Numeral 53 denotes fixtures which are used to hold each end on the input side and on the output side of the heating tubes 47 on the support frames 45, 46 respectively. These fixtures are made of polytetrafluoroethylene, and, as shown in FIG. 11, they are used with each heating tube 47 passing through holes 53*a* perforated on both end portions thereof. An assembly comprising support plates 44 and support frames 45, 46 of such a construction mentioned above is put in a bath 54 taking a vertically cylindrical shape wherein the chemical liquid is collected, suspended by receiving plates 55 which are provided projectingly on the inner circumferential surface of the bath 54. Steam is supplied from the connector 52 on the input side. the steam flows spirally from top to bottom through and along each tube 47 and is discharged out from the connector 51 on the output side. Therefore, the heat-exchange between steam and a chemical liquid is accelerated through the tube membranes in the bath 54, thereby the temperature of the liquid increases.

Explanations have been given about increasing the temperature of a chemical liquid in the bath 54 by circulating steam in the tubes 47. It, however, is also possible to lower the temperature of the chemical liquid, using a refrigerant instead of steam (a heat medium). It is also possible to perform a heat-exchange between a heat medium or refrigerant existing outside the heating tubes 47 and a chemical liquid flowing in the heating tubes 47.

Figure 12:
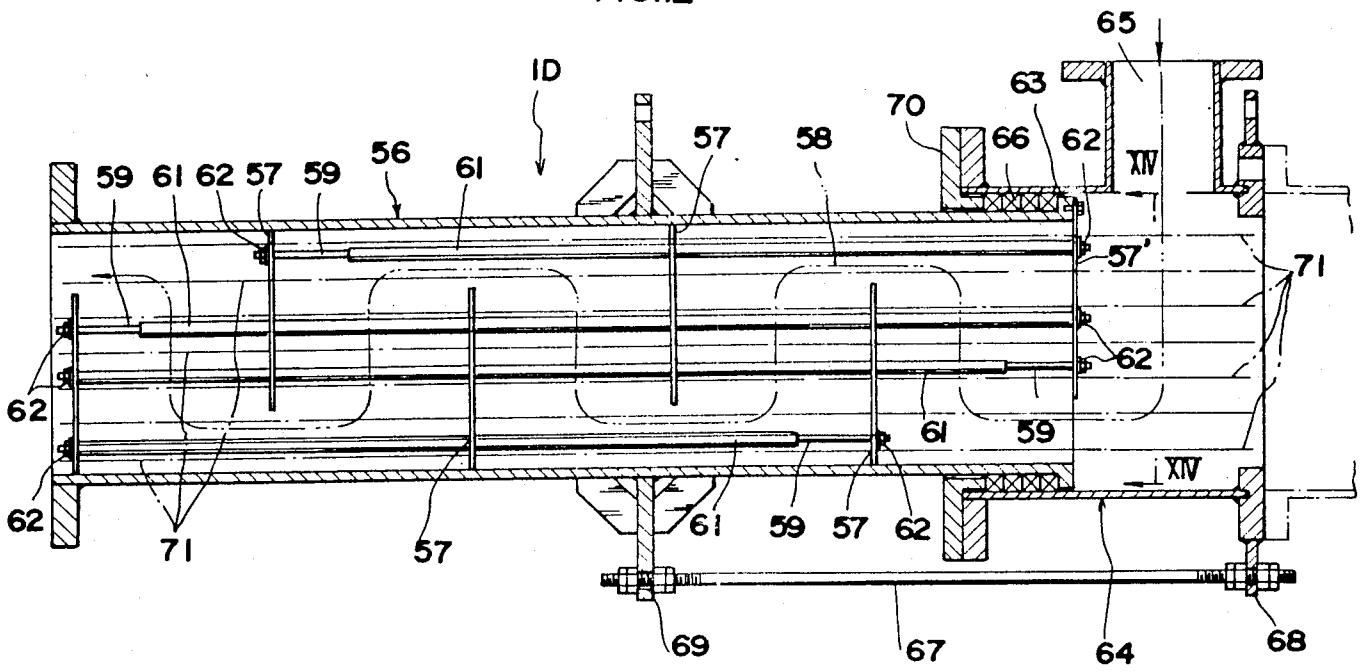
FIG. 12 is a vertical cross section of a further embodiment of the heat exchanging device of the present invention.
Figure 13:
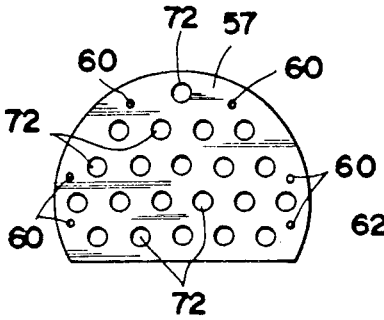
FIG. 13 is a front elevation of one of the baffle plates in the device illustrated in FIG. 12.
Figure 14:
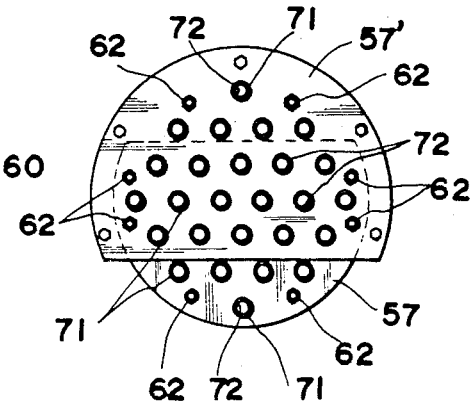
FIG. 14 is a cross section taken on line XIV—XIV of FIG. 12.

FIG. 12 shows a heat exchanging device 1D which is a further embodiment of the present invention. Now reference is made to this figure. In a horizontal cylindrical drum 56, plural number of segmental baffle plates 57 which cut the axial line of said drum 56 at right angles and function as support plates are provided at fixed positions in the axial direction of said drum in such a manner that each of them opposes reversally symmetrically with respect to one another to form a meandering flow path 58 for fluids outside the tubes (heating tubes) in said drum 56. In the cylindrical drum 56, plural number of baffle plate holding bars 59 are inserted in the axial direction of said drum 56. Baffle plates 57 are held and fixed at fixed positions by inserting said holding bars 59 in the holes 60 (see FIG. 13) perforated on the peripheral portion of each baffle plate 57 and further inserting each holding bar 59 in the pipe-shaped spacer 61 at each space between opposing baffle plates 57. Each baffle plate 57 is fixed by screwing nuts 62 at the end portions on outer sides of corresponding baffle plates 57. Either of the baffle plates on both extremities, namely, the baffle plate on the right extremity in FIG. 12 (shown under numeral 57'), for example, is formed with somewhat bigger diameter than the inner diameter of the cylindrical drum 56, and the peripheral portion of the baffle plate 57' is fixed to a flange 63 provided at the right extremity of the cylindrical drum 56 by a bolt and the like. In this way, these baffle plates 57 and baffle plate holding bars are fixed to the cylindrical drum 56. Numeral 64 denotes a short sleeve-like head connected concentrically to one extremity of the cylindrical drum 56, and said head is equipped with an inlet for fluids outside the tubes 65. Numeral 67 denotes a tie rod which is provided between a flange 68 provided at one end of the head 64 and another flange 69 provided in the middle of the cylindrical drum 56, while numeral 66 is a gland packing inserted between the cylindrical drum 56 and the head 64. The packing 66 is compressingly pushed onto the flange 63 through a flange 70 provided on the other end of the head 64 to allow the head 64 to contact tightly to the cylindrical drum 56 by rotating said tie rod 67 in the direction where the distance between the flanges 68 and 69 is widening.

Figure 15:
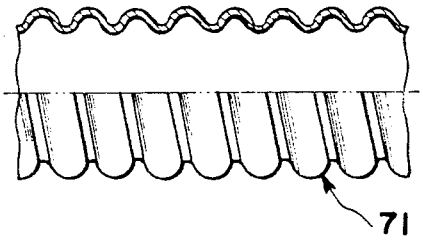
FIG. 15 is a vertical cross section of part of the heating tube in the device illustrated in FIG. 12.
Figure 16:
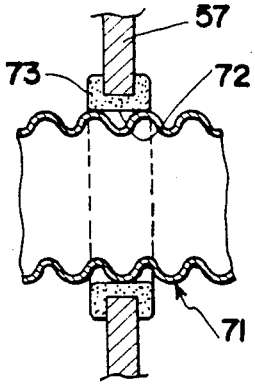
FIG. 16 is an explanatory cross section showing the construction of the baffle plates and the heating tubes inserted herein in the device illustrated in FIG. 12.

A plurality of heating tubes 71 are provided in the cylindrical drum 56 in parallel to the axial direction of the drum 1. Each heating tube 71 is made of a fluorocarbon resin, for example, polytetrafluoroethylene, and has a bellows-like shape. When we use a term "bellows-like", both of a type that cavities are formed spirally on a tube of a fluorocarbon resin and so called bellows-like type that annular elongated concavities and convexities are formed by turn successively on a tube of a fluorocarbon resin, as shown in FIG. 15, are acceptable. Each of the bellows-like heating tubes 71 of a fluorocarbon resin is threaded through each of the holes 72 which are provided at proper distances from one another throughout each of the baffle plates 57. As shown in FIG. 16, rubber bushes 73 are provided on each through hole 72. Each heating tube 71 is threaded through each hole 72 via bushes 73, so that the heating tubes are held surely and tightly with respect to the baffle plates 57.

In a heat exchanging device 1D of such a construction, when used as a heat exchanging device for cooling, the cooling liquid supplied from the inlet for fluids outside the tubes 65 of the head 64 into the cylindrical drum 56 flows along the meandering flow path 58 which is formed by baffle plates 57 to get to an outlet outside the tubes (not shown). The liquid to be cooled is supplied into each bellows-like heating tube 71, and is cooled by the cooling liquid which is flowing through the flow path 58 while flowing through the heating tubes 71. The liquid to be cooled is let into each heating tube 71 from inlets inside the heating tubes (not shown) provided on the drum 56 and is discharged from the drum 56 through said outlets inside the tubes.

In the heat exchanging device 1D as mentioned above, segmental baffle plates 57 which cut the axial line of said drum 56 at right angles are provided within the drum 56 at fixed positions in the axial direction of said drum 56 in such a manner that each of them opposes reversally symmetrically with respect to one another to form a meandering flow path 58 in the drum 56, so that the flow distance of the liquid becomes longer in comparison to that in a drum not provided with such baffle plates coincidental with the lowering of the velocity of flow of the liquid flowing outside the tubes, thereby an increase in the coefficient of heat transmission can be expected. Since the heating tubes 71 are made of a fluorocarbon resin, these tubes are highly resistant to corrosion and not corroded even when chemical liquids such as sulfuric acid and the like are used as a fluid flowing inside the tubes. A fluorocarbon resin is free from formation of dirts and scales because it lacks viscosity on its surface, which enables the heating tubes to be reduced in its thickness of the wall and its diameter, thereby the coefficient of heat transmission equal to or higher than that obtained in other heat exchanging devices of metals is obtained. Also, with these heating tubes 71, it is possible to raise the coefficient of heat transmission remarkably in comparison to the cases of flat tubes or round tubes, because these tubes are formed in bellows.

In the heat exchanging devices 1A to 1D as mentioned above, each heating tube is inserted in each through hole independently from one another and held against the support plates so that each heating tube might not contact to one another. Accordingly, broad heat exchanging surface area per tube can be secured, which enables it to perform effective heat exchange. Moreover, not only damaged heating tubes can be found easily but only the damaged heating tubes can be removed from the support plates. In this way, these heat exchanging devices have big advantageousness in the aspects of maintenance, workability and economy.

What is claimed is:

1. A heat exchanging device comprising a first fluid retaining means; a plurality of vertical substantially I-shaped support plates radially provided, the plates being within the retaining means and having a plurality of through holes arranged as a matrix having ranks; a plurality of heating tubes of a fluorocarbon resin passing in parallel, spaced apart relationship through said matrix of holes as to define a spiral path; means for supporting the I-shaped plates within the first fluid retaining means comprising annular upper and lower support frames, both upper-end and lower-end portions of said I-shaped plates being connected thereto, and tube supporting means supporting the end portions of said tubes, said tube supporting means being mounted to said means for supporting the I-shaped plates, whereby a second fluid circulating through the tubes exchanges heat with the fluid in the first fluid retaining means.

2. The heat exchanging device defined in claim 1 wherein the first fluid retaining means is a vertical bath, and wherein the support frames are of a fluorocarbon resin.

3. The heat exchanging device as defined in claim 1 wherein the tube supporting means is a U-shaped bracket, the closed end of which receives and the legs of which project beyond said means for supporting the I-shaped plates, the projecting portion proximate the I-shaped plate support means having a plurality of holes through which pass said plurality of tubes.

4. the heat exchanging device as defined in claim 1 further comprising for said tubes a common inlet header and a common outlet header, the end portions of each tube being supported by said tube support means mounted to the upper frame and extending upwardly to the respective headers.

* * * * *